United States Patent [19]

Bergamo et al.

[11] 4,245,019

[45] Jan. 13, 1981

[54] METHOD FOR REDUCING PATTERN STRIPES IN SLOTTED MASK SCREENS FOR CATHODE RAY TUBES

[75] Inventors: Robert L. Bergamo; Thaddeus V. Rychlewski; Siegbert M. Wirth, all of Seneca Falls, N.Y.

[73] Assignee: GTE Products Corporation, Stamford, Conn.

[21] Appl. No.: 929,744

[22] Filed: Jul. 31, 1978

[51] Int. Cl.[2] ..... H01J 29/32

[52] U.S. Cl. ..... 430/24; 427/43.1; 427/68

[58] Field of Search ..... 96/36.1; 354/1; 427/43, 427/44, 68, 43.1; 156/659; 430/24

[56] References Cited

U.S. PATENT DOCUMENTS

| | | | |
|---|---|---|---|
| 3,779,760 | 12/1973 | Miyaoka | 96/36.1 |
| 3,856,525 | 12/1974 | Inoue | 96/36.1 |
| 3,993,487 | 11/1976 | Hosokoshi | 96/36.1 |
| 4,053,906 | 10/1977 | Schultz | 96/36.1 |
| 4,059,834 | 11/1977 | Hosokoshi | 96/36.1 |
| 4,086,090 | 4/1978 | Kohashi | 96/36.1 |

*Primary Examiner*—James R. Hoffman
*Attorney, Agent, or Firm*—Thomas H. Buffton

[57] ABSTRACT

A method for forming patterned screens for cathode ray tubes wherein a multiplicity of viewing areas are spaced in accordance with and dimensionally smaller than openings of a mask member comprising the steps of coating the inner surface of a viewing panel with polyvinyl alcohol photosensitized with dichromate; exposing the viewing panel at a first positional location to radiant energy beamed through the mask openings; moving the viewing panel to a second positional location and exposing the viewing panel to radiant energy beamed through the mask openings; developing to remove the unexposed coating from the viewing panel; treating the exposed viewing panel with a dilute organic etching composition to erode the coating exposed to the radiant energy at one of the first and second positional locations; and washing the viewing panel to remove the etching composition and eroded coating leaving polymerized coating of a dimension smaller than the openings of the mask member.

10 Claims, 5 Drawing Figures

FIG. 1
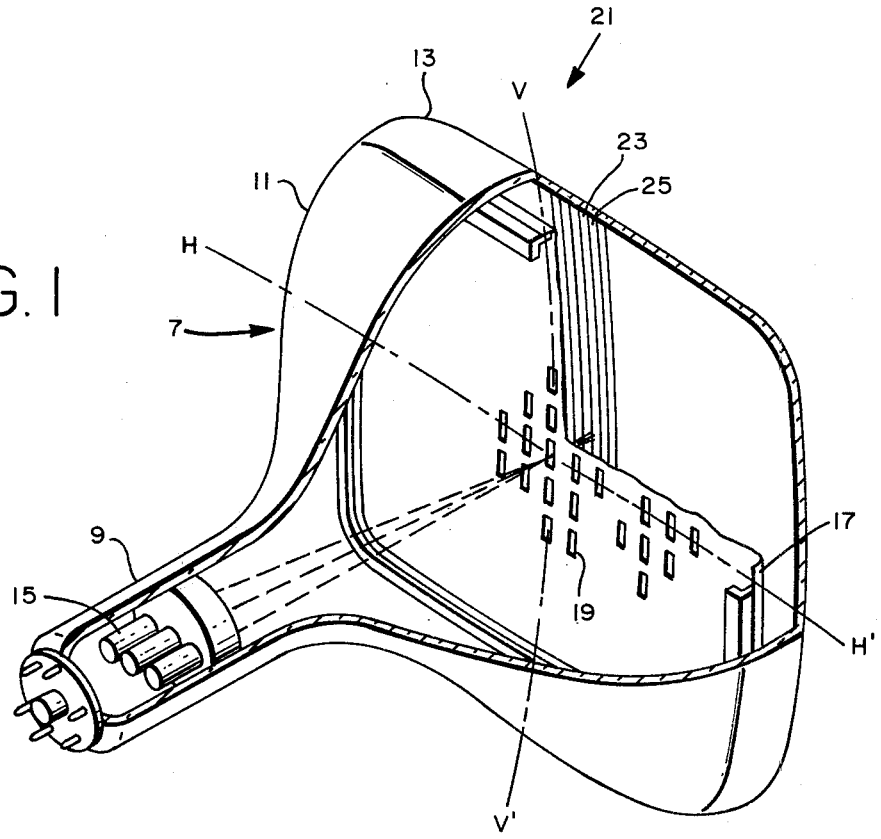
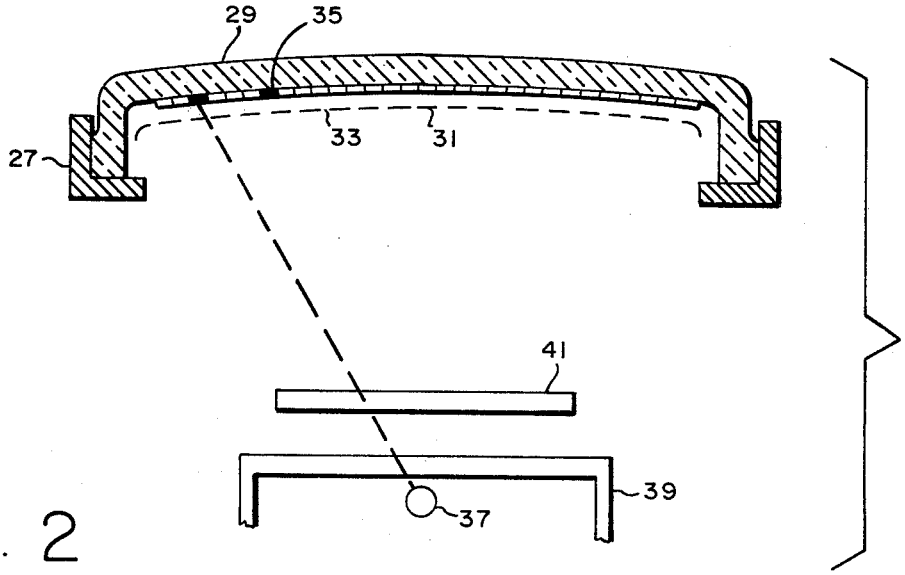
FIG. 2

METHOD FOR REDUCING PATTERN STRIPES IN SLOTTED MASK SCREENS FOR CATHODE RAY TUBES

BACKGROUND OF THE INVENTION

This invention relates to a method for forming a pattern of stripes on the viewing panel of a cathode ray tube and more particularly to a method for forming stripes smaller than the opening of a mask member affixed to the viewing panel of a cathode ray tube.

Color television receivers for providing color displays utilize cathode ray tubes having a viewing panel whereon is disposed a screen consisting of a multitude of repetitive groupings of color-emitting phosphor materials. In the most commonly encountered type of color cathode ray tube, a shadow mask member having a multitude of openings is spaced from the inner surface of the viewing panel whereon the pattern of phosphor materials is disposed. Moreover, the openings in the shadow mask member not only provide a passageway for electron beams to impinge a pattern of phosphor material when the cathode ray tube is operational but also serve as a passageway for radiant energy in fabricating the phosphor material pattern.

As mentioned, the color-emitting phosphors are usually in repetitive groupings such as the well-known triads of red, green and blue phosphor dots for example. However, it may be noted that as the color cathode ray tube art has advanced there has been a shift in emphasis and a tendency toward structures of the striped or slotted screen construction. Thus, repetitive groupings of color-emitting phosphor stripes appears to be replacing the well-known triad dot structures in popularity.

Additionally, it is well-known that closely spaced grouping of multiple colors i.e. triads of dots or stripes, have a tendency toward dilution of the desired contrast. As a result, it is and has been common to surround each of the color-emitting phosphors with a light absorbing substantially opaque material such as graphite for example. Moreover, this opaque material encompassment of the color-emitting phosphors provides improved contrast whereby the color display is enhanced.

In order to provide this opaque material encompassment of the color-emitting phosphor materials, it is known that the viewing area of the phosphor materials must be reduced in order to provide the space intermediate the viewed phosphor materials whereat the opaque material may be disposed. Since the area whereat the phosphor materials are deposited is dependent upon the openings in the mask member, one known technique for providing a phospor viewing area smaller than the mask openings is to pre-coat the mask prior to providing the phosphor viewing areas. Thereafter, the mask coating is removed whereby the mask openings are enlarged. Another similar technique is to etch or enlarge the openings of the mask after the phosphor areas have been determined. Both techniques have been found cumbersome and expensive and have not been a popular approach to the problem.

Other known techniques include under-exposure and etching of a photosensitive coating. In the under-exposure technique, radiant energy is beamed through the openings of the mask member in an amount sufficient to provide an area of polymerized material surrounded by an area of partially polymerized material. Thereupon, the partially polymerized material is washed away to leave an area of polymerized material which is smaller than the openings of the mask member. Although the technique has been and still is used with varying degrees of success it has been found that the polymerized and partially polymerized material tends to vary in size, thickness, density and adherence which is deleterious to the necessary screen uniformity. As a result, size control of the coating tends to be erratic and uniformity difficult to obtain.

Similarly, the etching technique involves exposing of a photosensitive coating through an apertured mask to provide areas of polymerized material which are larger than the openings of the mask, developing to remove the unpolymerized material and leave a pattern of polymerized materials, etching of the polymerized materials with a dilute etching solution to erode the polymerized material, and washing to remove the eroded materials. However, such etching techniques have been found somewhat difficult to adequately control due to the nonuniformity of the polymerized material. Thus, the technique has presented difficulties in present-day cathode ray tube manufacturing processes.

In one other technique for developing a screen having a pattern thereon which has viewing areas smaller than the openings of the associated mask member, a radiant energy source is movably associated with the mask member. In the process, a radiant energy source is beamed through openings in the mask to provide areas of polymerized and nonpolymerized material. The nonpolymerized material is removed and an opaque coating deposited in the area. The radiant energy source is moved and the process is repeated with the area of non-polymerized material overlapping the opaque coating. The non-polymerized material is removed and opaque material placed adjacent to and overlapping the original opaque material. Thus, an area smaller than the openings of the mask is developed whereat the phosphors are deposited. Obviously, such a process is expensive, complex and requires exacting control.

OBJECTS AND SUMMARY OF THE INVENTION

An object of the present invention is to obviate or at least reduce the disadvantages of the prior art. Another object of the invention is to provide an enhanced method for reducing the dimensioning of the patterned area of the screen structure on the viewing panel of a cathode ray tube. Still another object of the invention is to provide a process for improving the uniformity of reduced dimensioning of a striped pattern on the viewing panel of a cathode ray tube. A further object of the invention is to improve the dimensioning of a striped pattern by a combination of etching and movement of the viewing panel of a cathode ray tube.

These, and other objects, advantages and capabilities are achieved in one aspect of the invention by a method wherein a coating of photosensitized polyvinyl alcohol is deposited on the inner surface of a cathode ray tube viewing panel, exposed at a first positional location to radiant energy beamed through the openings in an adjacent mask member, moved to a second positional location and exposed to radiant energy beamed through the openings of the mask member to provide areas of non-polymerized, polymerized and partially polymerized coating, developed to remove the non-polymerized coating, treating with a dilute organic etching composition to erode the partially polymerized coating, and washed with water to remove the eroded partially polymerized coating and provide polymerized stripes of a dimension smaller than the openings of the mask member.

BRIEF DESCRIPTION OF THE DRAWINGS

FIG. 1 is a sketch illustrating an in-line color cathode ray tube with a striped pattern of phosphor materials;

FIG. 2 is a diagrammatic sketch of a "lighthouse" suitable for fabrication of a patterned screen on the viewing panel of a cathode ray tube.

PREFERRED EMBODIMENT OF THE INVENTION

Figure 3:
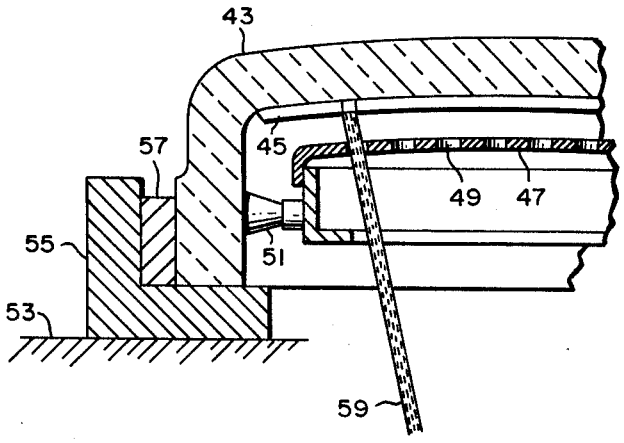
FIG. 3 is a diagrammatic illustration, in section, of a cathode ray tube with a viewing panel at a first positional location and impinged by radiant energy.

For a better understanding of the present invention, together with other and further objects, advantages and capabilities thereof, reference is made to the following disclosure and appended claims in conjunction with the accompanying drawings.

Referring to the drawings, FIG. 1 illustrates a color cathode ray tube having an envelope 7 which includes a neck portion 9 and a funnel portion 11 with a face panel or viewing panel 13 frit sealed to the funnel portion 11. The neck portion 9 includes a plurality of electron guns 15 aligned in a plane and sealed therein. The viewing panel 13 has a mask member 17 affixed thereto and spaced from the inner surface thereof and including a multiplicity of openings 19 which in this instance are in the form of slots. The viewing panel 13 also has a pattern 21 of color-emitting phosphors disposed on the inner surface thereof and in this instance the pattern 21 is in the form of phosphor-emitting stripes 23 separated by stripes 25 of an opaque material such as graphite for example. Moreover, the elect on guns 15 are aligned along the horizontal axis H–H' while the color-emitting phosphor stripes 23 and opaque stripes 25 extend along the vertical axis V–V' of the viewing panel 13.

In the process of fabricating color cathode ray tubes, it is a common practice to employ a so-called "lighthouse" as illustrated in FIG. 2. As is well known, the "lighthouse" usually includes a support 27 whereon is disposed the viewing panel 29 of a cathode ray tube. The viewing panel 29 has an affixed mask member 31 with a multitude of openings 33 therein and is spaced from a photosensitive coating 35 disposed on the inner surface of the viewing panel 29. A source 37 provides radiant energy which is beamed through a lens 39, a "shader" plate 41 and the openings 33 of the mask member 31 to provide a designated pattern on the inner surface of the viewing panel 29.

Figure 4:
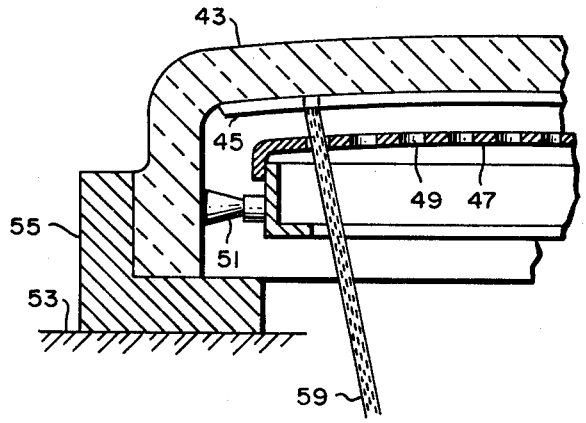
FIG. 4 is another diagrammatic illustration, in section, of the cathode ray tube viewing panel at a second positional location and impinged by radiant energy.
Figure 5:
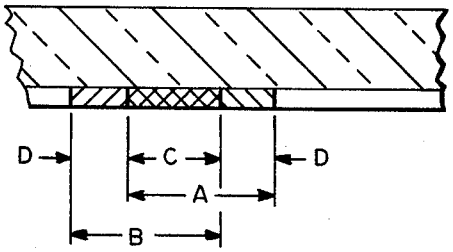
FIG. 5 diagrammatically illustrates a resultant pattern of polymerized and partially polymerized photosensitive coating in accordance with the illustrations of FIGS. 1 and 2.

More specifically, FIGS. 3, 4, and 5 diagrammatically illustrate the utilization of a "lighthouse" in a preferred method for forming a patterened screen on the inner surface of a viewing panel of a cathode ray tube. In FIG. 3, a viewing panel 43 of a color cathode ray tube has a coating of photosensitive material 45, such as polyvinyl alcohol sensitized with a dichromate, deposited on the inner surface thereof. A mask member 47 having a multitude of openings 49 therein is spaced from the coating 45 and affixed to the viewing panel 43 by an attachment means 51. The viewing panel 43 is deposited onto a support means 53 having an upstanding portion 55. A shim member 57 spaces the viewing panel 43 from the upstanding portion 55 of the support means 53 during a first positional location whereat radiant energy 59 is beamed through the openings 49 of the mask member 47 and impinges the coating 45 to provide a pattern thereon.

In FIG. 4, the viewing panel 43 is again deposited on the support means 53. However, in this second positional location the viewing panel is moved into contact with the upstanding portion 55 of the support means 53. In other words, the shim member 57 of FIG. 4 has been removed and the viewing panel 43 laterally displaced along a horizontal axis. As a result, impingement of the coating 45 by the beamed radiant energy 59 is also laterally displaced along a horizontal axis.

As can more clearly be seen in FIG. 5, the photosensitive coating 45 on the inner surface of the viewing panel 43 is impinged over an area "A" by radiant energy 59 when the viewing panel is disposed at a first positional location, FIG. 3, on the support means 53. Also, an area "B" of the photosensitive coating 45 is impinged by radiant energy 59 when the viewing panel is disposed at a second positional location, FIG. 4, on the support means 53. As a result, an area, "C", of the coating 45 is impinged by radiant energy during the period the viewing panel 43 is at both the first and second positional locations while an area "D" receives radiant energy impingement only during the period when the viewing panel 43 is in either the first or the second positional location. Thus, the area "C" which receives exposure during both positional location periods tends to become polymerized while the area "D" is polymerized at a reduced amount or is partially polymerized.

In one embodiment of the invention, a plurality of vertically-aligned stripes of a size smaller than the openings in an associated mask member are separated by stripes of an opaque material. In the process, the inner surface of a viewing panel of a cathode ray tube is coated with a thin, uniform layer of an aqueous solution of polyvinyl alcohol (PVA) sensitized with a suitable photosensitizer material such as potassium or ammonium dichromate. The PVA solutuon includes PVA solids in the range of about 1.2 to 2.5 weight percent while the dichromate solids are preferably in the range of about 0.1 to 0.2 weight percent. Moreover, the applied coating preferably has a viscosity in the range of about 5.0 to 8.0 centipoises.

After the photosensitized coating has been applied to the inner surface of the viewing panel, a mask member having multiple openings is affixed to the viewing panel and spaced from the coating on the inner surface thereof. The viewing panel is placed in a first positional location on a support member of a "lighthouse" with a shim member (FIG. 3) employed to space the viewing panel from the support member along a horizontal axis. The coating is then exposed to radiant energy beamed through the openings of the mask member whereby a partial polymerization of the photosensitive coating is effected.

Following, the shim member is removed (FIG. 4) and the coating is again exposed to radiant energy beamed through the openings of the mask member. In this manner, one area of the coating is impinged by radiant energy during the periods the viewing panel is in both the first and second positioned locations to provide a polymerized area. Also, the remaining exposed areas are impinged by radiant energy only during either the period of the first positional location of the viewing panel or the period of the second positional location of the viewing panel. Thus, the remaining exposed areas are polymerized a reduced amount or partially polymerized. Moreover, a preferred method provides for exposure at each of the first and second positional locations for a period of about 50% of the total exposure time.

Thereafter, the viewing panel is removed from the "lighthouse" and the mask member is removed from the viewing panel. The coating is subjected to a flow of substantially unpressurized water whereby a major portion of the unexposed and unpolymerized coating layer is removed leaving a pattern of polymerized and partially polymerized coating.

Thereupon, the polymerized and partially polymerized pattern of coating is subjected to treatment by a dilute, weak organic etching composition. An etching composition may be selected from the group consisting essentially of acetic, citric and oxalic acids and the respective ammonium salts thereof such as ammonium acetate, ammonium citrate, and ammonium oxalate. Moreover, an example of the etching composition is in the form of an aqueous solution within the range of about 0.2 to 5.0 weight percent and a dilute organic acid has a range of about 0.5 to 1.5 weight percent while the ammonium salts of the acid have a range of about 1.0 to 3.0 weight percent. Thus, the dilute etching composition tends to erode the polymerized edges and particularly the partially polymerized coating forming the pattern on the inner surface of the viewing panel.

Having treated the viewing panel to the dilute etching composition for a period of time sufficient to achieve the desired amount of erosion, pressurized water is applied to the inner surface of the viewing panel whereat the pattern is disposed in an amount sufficient to remove the etching materials and the eroded materials resulting from the etching treatment. Thus, a pattern of polymerized coating remains which is dimensionally smaller than the openings of the mask member which formed the pattern. In this instance, stripes of a horizontal width less than the horizontal width of the mask openings and extending along a vertical axis are provided.

The patterned inner surface of the viewing panel is then overcoated with a uniform layer of an opaque coating composition such as a graphite suspension for example. Moreover, the excess coating is drained and the panel is allowed to dry in a normal manner or a small amount of heat to effect a drying temperature of about 35°-50° C. is employed.

Following, a suitable degrading agent such as a 5.0 to 30.0 percent aqueous solution of hydrogen peroxide is applied to the graphite overcoated inner surface of the viewing panel. In a manner well known in the art, the hydrogen peroxide causes an efferscense of the pattern of polymerized polyvinyl alcohol (PVA) without deleterious effect upon the graphite overcoating adhered directly to the surface of the viewing panel.

Thereafter, a vigorous water rinse is employed to cause removal of the degrading agent as well as the degraded materials. Thus, there remains a pattern of stripes of opaque material separated by stripes of window-areas or glass panel areas which are of a dimension smaller than the dimension of the openings of the mask member as measured along a horizontal axis of the viewing panel.

Finally, the multiple phosphor elements of a cathodoluminescent screen are deposited onto the window or glass panel areas intermediate the stripes of opaque material. Moreover, such phosphor deposition techniques are conventional in color cathode ray tube fabrication processes.

Additionally, the basic process of providing striped areas of a dimension smaller than the openings of a mask member serving as a pattern by positionally locating the viewing panel is first and second positions is especially applicable to methods wherein an opaque coating is not employed. However, therein the photosensitive coating is subjected to radiant energy in first and second positional locations, treated to etch away the partially polymerized coating and leave a polymerized coating of reduced dimensions. The polymerized coating is removed and color-emitting phosphors are deposited to replace the polymerized coating.

Thus, there has been provided a method for fabricating patterned screens on the viewing panel of a cathode ray tube. This unique method provides a pattern of reduced dimensional size as compared with the openings of a mask member wherefrom the pattern was developed. Moreover, the unique controlled variations in exposure of the photosensitive materials provide enhanced control of the erosion and consequently, the size of the apertures wherein the phosphor elements are deposited.

While there has been shown and described what is at present considered the preferred embodiments of the invention, it will be obvious to those skilled in the art that various changes and modifications may be made therein without departing from the invention as defined by the appended claims.

We claim:

1. In a method for manufacture of a color cathode ray tube having a viewing panel whereon is formed a patterned screen having a multiplicity of discretely formed stripes spaced in accordance with and dimensionally smaller than multiple openings of a mask member affixed to the viewing panel and spaced from the patterned screen, a method for forming the patterned screen comprising the steps of coating the inner surface of a cathode ray tube viewing panel with a thin uniform layer of an aqueous solution of polyvinyl alcohol photosensitized with a dichromate material;

exposing said viewing panel at a first positioned location to radiant energy beamed through said multiple openings of said mask member for a given period of time to partially polymerize discrete striped portions of said photosensitive coating;

moving said viewing panel to a second positional location and exposing said viewing panel to radiant energy beamed through said multiple openings of said mask member for a given period of time to partially polymerize other discrete striped portions of said photosensitive coating and to polymerize striped portions of said partially polymerized coating exposed to said radiant energy during exposure at said first positional location;

developing to remove the unexposed photosensitive coating from said viewing panel and leave polymerized and partially polymerized coating portions;

treating said polymerized and partially polymerized portions of said photosensitive coating with a dilute organic etching composition to erode said partially polymerized portions of said photosensitive coating; and washing the exposed coating with pressurized water to remove said dilute organic etching composition and said eroded partially polymerized portions of said photosensitive coating whereby stripes of polymerized coating of a dimension smaller than the dimension of said openings of said mask member remain affixed to the inner surface of said viewing panel.

2. The method of claim 1 wherein said stripes of said photosensitive coating extend in the direction of the vertical axis of said viewing panel and said moving of said viewing panel from said first to a said second positional location is effected along an axis normal to said vertical axis.

3. The method of claim 1 wherein said stripes of said photosensitive coating and said mask member extend in the direction of a vertical axis of said viewing panel and mask member and said moving of said viewing panel to a second positioned location is effected in a direction along a horizontal axis of said viewing panel.

4. The method of claim 1 wherein said exposing of said viewing panel at a first positional location is effected for about 50% of the total exposure time of said viewing panel.

5. The method of claim 1 wherein said exposing of said viewing panel at said second positional location is effected for about 50% of the total exposure time of said viewing panel.

6. The method of claim 1 wherein said polymerized portion of said photosensitive coating is exposed for a period twice as long as the period of exposure of each of said partially polymerized portions of said photosensitive coating.

7. A method for forming a patterned screen on the viewing panel of a cathode ray tube wherein the patterned screen includes a multiplicity of stripes spaced and dimensionally smaller than multiple openings in a mask member affixed to and spaced from the patterned screen on the viewing panel, said method comprising the steps of:

coating the inner surface of a cathode ray tube viewing panel with a thin uniform layer of an aqueous solution of polyvinyl alcohol photosensitized with a dichromate material;

exposing said coating viewing panel at a first positional location to radiant energy beamed through said multiple openings of said mask member for a given period of time to partially polymerize discrete striped portions of said photosensitive coating;

moving said coated viewing panel to a second positional location and exposing said viewing panel to radiant energy beamed through said multiple openings of said mask member for a given period of time to partially polymerize other discrete striped portions of said photosensitive coating and to polymerize striped portions of said partially polymerized coating exposed to said radiant energy during exposure at said first positional location;

developing to remove unexposed photosensitive coating from said viewing panel and leave polymerized and partially polymerized coating portions;

treating said polymerized and partially polymerized portions of said photosensitive coating with a dilute organic etching composition to effect erosion of said partially polymerized portions of said photosensitive coating; and washing said exposed coating with pressurized water to effect removal of said dilute organic etching composition and said eroded partially polymerized portions of said photosensitive coating;

overcoating said polymerized striped portions and said area of removed partially polymerized portions of said photosensitive coating with a graphite suspension;

drying said overcoating of graphite suspension treating said overcoated panel with a water-soluble degrading agent to degrade said polymerized stripes of photosensitive coating covered with said graphite suspension; and washing said treated overcoated panel to remove said degraded polymerized stripes and overcoating thereon and provide a patterned striped area of said viewing panel of a dimension smaller than the dimension of said openings of said mask member with stripes of opaque graphite therebetween.

8. The method of claim 7 wherein said stripes extend in the direction of a vertical axis of said viewing panel and said moving of said viewing panel from a first to a second positional location is directed along an axis horizontal to said vertical axis.

9. The method of claim 7 wherein said exposure of said viewing panel to said radiant energy is effected for about 50% of the exposure time at each of said first and second positional locations.

10. The method of claim 7 wherein said partially polymerized and polymerized portions of said coated viewing panel are exposed for 50% and 100% of the exposure time respectively.

* * * * *